US009033756B2

(12) United States Patent
Petersson et al.

(10) Patent No.: US 9,033,756 B2
(45) Date of Patent: May 19, 2015

(54) VERTICAL PUMPING APPARATUS AND METHOD FOR DISTRIBUTION MERCURY IN A PUMPING AND LAMP GAS-FILLING PROCESS

(71) Applicant: Auralight International AB, Karlskrona (SE)

(72) Inventors: Tommy Petersson, Hasslö (SE); Hans Mårtensson, Karlskrona (SE)

(73) Assignee: Auralight International AB, Karlskrona (SE)

( * ) Notice: Subject to any disclaimer, the term of this patent is extended or adjusted under 35 U.S.C. 154(b) by 0 days.

(21) Appl. No.: 14/355,061

(22) PCT Filed: Nov. 1, 2012

(86) PCT No.: PCT/SE2012/051193
§ 371 (c)(1),
(2) Date: Apr. 29, 2014

(87) PCT Pub. No.: WO2013/100842
PCT Pub. Date: Jul. 4, 2013

(65) Prior Publication Data

US 2014/0287645 A1 Sep. 25, 2014

(30) Foreign Application Priority Data

Nov. 4, 2011 (SE) ..... 1151039-3

(51) Int. Cl.
*H01J 9/395* (2006.01)
*H01J 9/00* (2006.01)
*H01J 9/38* (2006.01)

(52) U.S. Cl.
CPC .. *H01J 9/395* (2013.01); *H01J 9/38* (2013.01)

(58) Field of Classification Search
CPC ..... H01J 65/048; H01J 61/56; H01J 5/54; H01J 61/28; H01J 61/72; H01J 61/523; H01J 61/34; H01J 9/247; H01J 1/15; H01J 61/0677; H01J 61/0737; H01J 9/042; H01J 9/38; H01J 9/395; H01J 13/06; H01J 2893/0059; H01J 2893/0061; H01J 2893/0075; H01J 29/865; H01J 37/18; H01J 37/3007; H01J 37/3053; H01J 37/3171; H01J 37/34; H01J 37/36; H01J 3/025; H01J 41/12; H01J 41/16
USPC ..... 445/15–16, 38, 42, 53, 56, 26
See application file for complete search history.

(56) References Cited

U.S. PATENT DOCUMENTS 2,247,513 A * 7/1941 Marshaus ..... 445/73
2,374,304 A * 4/1945 Owings ..... 445/70

(Continued)

FOREIGN PATENT DOCUMENTS

EP 0 669 639 A1 8/1995
GB 543079 * 2/1942 ..... H01J 9/38

OTHER PUBLICATIONS

International Search Report for PCT/SE2012/051193 dated Feb. 15, 2013.

*Primary Examiner* — Donald Raleigh
(74) *Attorney, Agent, or Firm* — Knobbe Martens Olson & Bear LLP

(57) ABSTRACT

The present invention relates to a method of and a vertical pumping device (1) for internally distributing Hg in a fluorescent tube body (3). The bottom (7) of the fluorescent tube body (3) is closed. The device (1) arranges, in a first position, a first solid body (9') comprising a predetermined first amount of bound Hg. The device (1) arranges, in a second position, a second solid body (9") comprising a predetermined second amount of bound Hg. A first release (E1) of the first amount of Hg is achieved in the fluorescent tube body (3) by gasification with heat and under pressure for purification of contaminant particles in the fluorescent tube body. A second release (E2) of the second amount of Hg is achieved in the fluorescent tube body (3) by gasification attained for the occluded mercury vapour of the fluorescent tube body (3).

16 Claims, 4 Drawing Sheets

(56) References Cited

Figure 1:
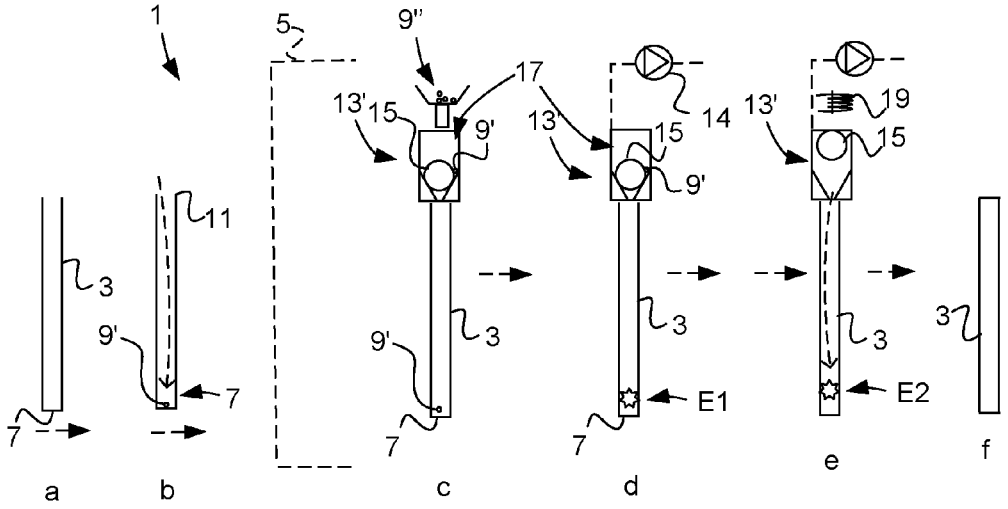

U.S. PATENT DOCUMENTS 2,449,637 A * 9/1948 Blake et al. ..... 445/26
4,145,634 A 3/1979 Evans et al.
5,286,227 A * 2/1994 Numajiri et al. ..... 445/26
5,757,129 A * 5/1998 Schafnitzel et al. ..... 313/565
2001/0038264 A1 11/2001 Brumleve et al.
2007/0071635 A1 3/2007 Hansen

* cited by examiner

VERTICAL PUMPING APPARATUS AND METHOD FOR DISTRIBUTION MERCURY IN A PUMPING AND LAMP GAS-FILLING PROCESS

CROSS REFERENCE TO RELATED APPLICATIONS

This application is a U.S. National Phase Application of PCT International Application No. PCT/SE2012/051193, filed on Nov. 1, 2012, designating the United States of America and published in the English language, which is an International Application of and claims the benefit of priority to Swedish Patent Application No. 1151039-3, filed on Nov. 4, 2011. The disclosures of the above-referenced applications are hereby expressly incorporated by reference in their entireties.

TECHNICAL FIELD

The present invention relates to a method of internally distributing Hg in a fluorescent tube body in a vertical pumping device in accordance with claim 1 and the vertical pumping device per se according to the introductory portion of claim 8.

The invention concerns the manufacturing industry for the manufacture of fluorescent tubes, where a purification process for the interior of the fluorescent tube body takes place in a so-called vertically operating pumping process. The purification takes place before a final amount of lamp gas intended for the operation of the fluorescent tube is filled in the fluorescent tube body.

BACKGROUND

The purification process (the pumping process) brought about by the vertical pumping device comprises a vacuum system (underpressure system) which creates an underpressure in the fluorescent tube body and a targeted particle flow with particles to be removed from the fluorescent tube body. This particle flow in the fluorescent tube body stops when degassing of substances has ceased. Sometimes, the particle flow may even reverse.

In order to solve this problem, a technique has been developed which supplies substances creating a new particle flow. This technique employs liquid mercury, which is applied in the interior of the fluorescent tube body at the lower part of the fluorescent tube body. The mercury gasifies with great expansion. The gasified mercury also has the ability to bind contaminants. At the expansion, the mercury thus binds the contaminants and conveys them out of the fluorescent tube body in the additional particle flow obtained. The liquid mercury, provided in order to create the additional particle flow, is dosed at the pumping process in a first position where gasification has ceased and pumping out of particles is most desirable. The dosing is done by flow throttling. When the lamp then reaches the end of the vertical pumping device with ensuing final filling of the lamp gas, an additional amount of mercury will be dosed into the fluorescent tube body to provide the lamp gas for the operation of the fluorescent tube. Earlier on, vertical pumping devices were thus filled with liquid mercury, which worked production-technically, but which at the same time entailed a ten percent loss of mercury.

The document JP 2000208050 shows a device for distributing bound mercury in pellet form. An electromagnet is arranged to lift a valve when the intended pellets are supplied.

The aim with the device is to prevent involuntary supply of pellets into the fluorescent tube body because of device vibrations.

SUMMARY OF THE INVENTION

The need remains to be able to devise the above method and pumping process more environmentally friendly than what has hitherto been achieved. Traditional vertical pumping devices work satisfactorily, but are now being subject to further developments.

Hence, it is the object of the invention to devise a pumping process where the environmental adaptation is greater simultaneously with an excellent purification of the fluorescent tube body being achieved.

Likewise, it is the object to achieve a cost-effective distribution of mercury for the pumping process, whereby the consumption of mercury can be minimized.

It is also the object is to devise a vertical pumping device which operationally reliably can distribute mercury in a fluorescent tube body, where the fewest possible movable parts are acting in the vertical pumping device during the pumping process.

DESCRIPTION OF THE INVENTION

The above objects have been obtained by the method defined in the preamble according to the steps set forth in claim 1.

In this way a method has been achieved, which allows an exact distribution of mercury partly for the purification and pumping process, and partly the final dosing per se of mercury. This exact distribution for both purification and final filling entails that no superfluous mercury is generated in the process, which spares the environment. The exact dosing also brings about cost savings in the production. The environment of the service staff likewise gets better by way of a controlled amount of supplied mercury in solid form for the entire vertical pumping process, both as regards pumping/purification of the fluorescent tube body and final filling of mercury for the production of the lamp gas.

Preferably a step is effected of coupling the upper end of the fluorescent tube body to an evacuation pump to bring about an underpressure in the fluorescent tube body before the step of arranging, in the first position, the first solid body.

The method thereby allows automated operation for vertical pumping where the fluorescent tube body is retained to the vertical pumping device directly by connecting the fluorescent tube body to the vertical pumping device, and an underpressure can be applied rapidly in the interior of the fluorescent tube body immediately after arranging the first and the second position with respective first and second amounts of bound mercury. In this way an effective cost-saving pumping can be achieved.

In the first position, the first solid body is expediently dropped manually to the bottom before a valve unit is applied connecting to the fluorescent tube body, the valve unit being arranged in such a manner as to be openable by magnetic force so that, in the second position, the second solid body can drop down into the fluorescent tube body by gravity.

In this way the vertical pumping device can be made less voluminous, as the first solid body can be dropped down (arranged) into the fluorescent tube body before the valve unit is applied connecting to the upper part of the fluorescent tube body. The valve unit can be made less voluminous as just one solid body needs to be arranged after the said connection has been made.

Alternatively, a valve unit is arranged in such a manner as to be openable by magnetic force so that, in the first position, the first solid body can drop down by gravity to the bottom of the fluorescent tube body and that, in the second position, the second solid body can drop down into the fluorescent tube body by gravity.

Thereby, the valve can easily be controlled to open and close partly for arranging the bodies in the valve, partly for dropping down each of the bodies separately into the fluorescent tube body at chosen times. The control can be effected with few movable parts and without through-going parts which could affect the created underpressure required for the release of mercury through the gasification.

Preferably, a distribution valve is arranged with a first valve element delimiting an upper and a lower chamber of the distribution valve and a second valve element delimiting the lower chamber and the fluorescent tube body, the method comprising the step of placing, after the distribution valve has been applied connecting to the fluorescent tube body, the first and the second solid body in the lower and the upper chamber, respectively.

In this way the first body may be arranged in a lower position, which is first given the opportunity to open for dropping down from the lower chamber, and the second body can be given the opportunity to drop down to the lower chamber so as to be able to drop down from there, in a later position, into the fluorescent tube body when the valve is made to open towards the fluorescent tube body.

The step of releasing the fluorescent tube body from the vertical pumping device is expediently preceded by a step of closing the other upward facing end of the fluorescent tube body.

Thereby, the fluorescent tube can be closed with lamp gas already when it is to leave the vertical pumping device, which is cost-effective.

Alternatively, the method comprises achieving the solid bodies with bound Hg by cutting of bar blanks of bound mercury in solid form to predetermined lengths and subsequent conveyance of these cut bodies to the vertical pumping device, whereby a cost-effective production of fluorescent tubes can take place.

The above objects also have been obtained by the vertical pumping device defined in the preamble according to the characterizing portion of claim 8. In this way a vertical pumping device is accomplished, which allows exact distribution of mercury partly for the purification and pumping process, partly the final dosing per se of mercury. This exact distribution for both purification and final filling entails that no superfluous mercury is generated in the process, which spares the environment. The exact dosing also brings about cost-savings in the production. The environment of the service staff likewise gets better by way of controlled amount of bound mercury in solid form for the entire vertical pumping process, both for pumping/purification of the fluorescent tube body and for final filling of mercury for the production of the lamp gas.

Preferably, a distribution valve arranged at each support position is to take up the first and the second solid body and, in separate process positions, feed them further on to the respective fluorescent tube body, each distribution valve comprising a first and a second valve element, each of which is separately influenceable by magnet units fixedly arranged in predetermined process positions of the vertical pumping device to arrange the first and the second body in a first and a second position, respectively.

In this way an automatic device may be obtained cost-efficiently for exact distribution of both the first body and the second body.

A distribution valve arranged at each support position is expediently designed with a first valve element delimiting an upper and a lower chamber, and a second valve element, in operation delimiting the lower chamber from the fluorescent tube body, the first valve element being arranged so as to be influenceable by magnet units while the second valve unit remains in closed position, and where the second valve element is arranged so as to be influenceable by magnet units while the first valve unit remains in closed position.

The first body can thereby be arranged in the lower position and be given the opportunity, by opening of the second valve element, to be dropped down into the fluorescent tube body, and release of mercury takes place.

The second body can be given the opportunity to drop down into the lower chamber from the upper chamber in order, in a later position, to be able to drop down from the lower chamber into the fluorescent tube body when the valve is made to open towards the fluorescent tube body. Thereby, the valve can easily be controlled to open and close, partly for arranging the bodies in the valve, partly for dropping down each of the bodies separately into the fluorescent tube body at chosen times for release of an exact amount of mercury. The control can be effected with few movable parts and without through-going parts which could affect the created underpressure required for the release of mercury through the gasification.

Alternatively, the magnet unit consists of a first electromagnet generating a first force, and of a second electromagnet generating a second force, the said electromagnets being placed in predetermined separate process positions.

An automated cost-efficient production has thereby been achieved.

Preferably, the first and the second electromagnets generate forces in opposite directions.

Thereby a compact vertical pumping device can be obtained, where the first electromagnet works to press down the first valve element, made from stainless steel, in the direction towards a spring force for opening of a gap through which the body can fall for arranging the second position, and the first electromagnet also works to press down the second valve element tightly (so that at least the solid body is prevented from falling through) against a shoulder between the lower chamber and the fluorescent tube body. The second electromagnet works, at the second release, to lift the second valve element so that the body can fall down into the fluorescent tube body simultaneously with the second electromagnet working to lift the first valve element against a shoulder, which the said spring force also makes the first valve element abut against when the support position is in another indexing position than in the position adjacent to or in line with the first electromagnet. In this way current can control the force and the velocity with which the valve is opened, depending on the application. The vertical pumping device may cooperate with a computer to control the valves without the underpressure being influenced by movable through-going parts.

Alternatively, the magnet unit may be a permanent magnet.

Preferably, the first and a second valve element of the distribution valve are formed by a partition wall arranged in a hollow cylindrical cylinder being rotatable about its axis of rotation, around which, and on substantially opposite sides, there are arranged storage spaces for first and second solid bodies, respectively.

Thereby, first and second solid bodies can be filled (arranged in an indexing position, which is time saving. When the first body is to be placed into the fluorescent tube body for the first release of mercury, the hollow spindle is rotated a quarter of a turn about its axis of rotation by means of a camming motion, and then, to close, a quarter of a turn back. When the second body is to be placed into the fluorescent tube body for the second release of mercury, the hollow spindle is rotated a quarter of a turn in the direction towards the previously made quarter of a turn by means of a second camming motion.

The first indexed process position allowing release of the first amount of Hg in the fluorescent tube body is expediently arranged with means in the form of heat. The first solid body can thus be dropped down manually to the bottom before a valve unit is applied connecting to the fluorescent tube body. The valve unit is arranged in such a manner as to be openable by magnetic force so that, in the second position, the second solid body which was loaded in the valve unit can drop down into the fluorescent tube body by gravity. In this way the vertical pumping device can be made less voluminous as the first solid body can be dropped down (arranged) in the fluorescent tube body before the valve unit is applied connecting to the upper part of the fluorescent tube body. The valve unit can be made less voluminous because just one solid body (the second solid body) needs to be arranged after this connection has been made.

Preferably, a unit is provided for arranging, in a third position, at least one third solid body comprising a predetermined third amount of bound Hg so as to be able to bring about a third release of the third amount of Hg in the fluorescent tube body through gasification.

Thereby, complementary gasification can be achieved with an exact amount of mercury.

SHORT DESCRIPTION OF THE FIGURES

Figure 3:
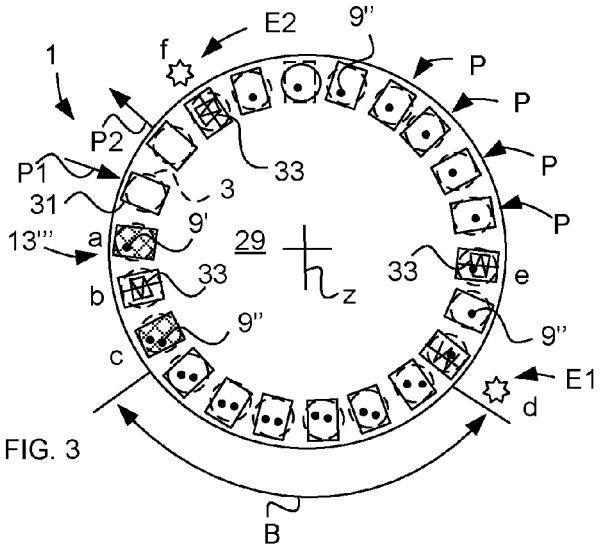
Figure 2:
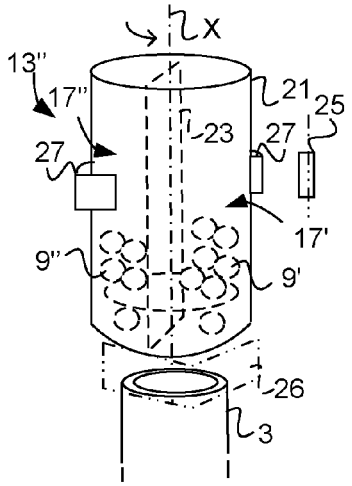
Figure 4:
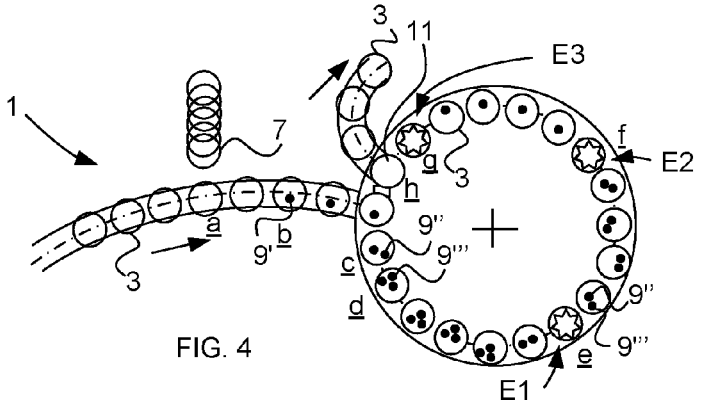
Figure 5:
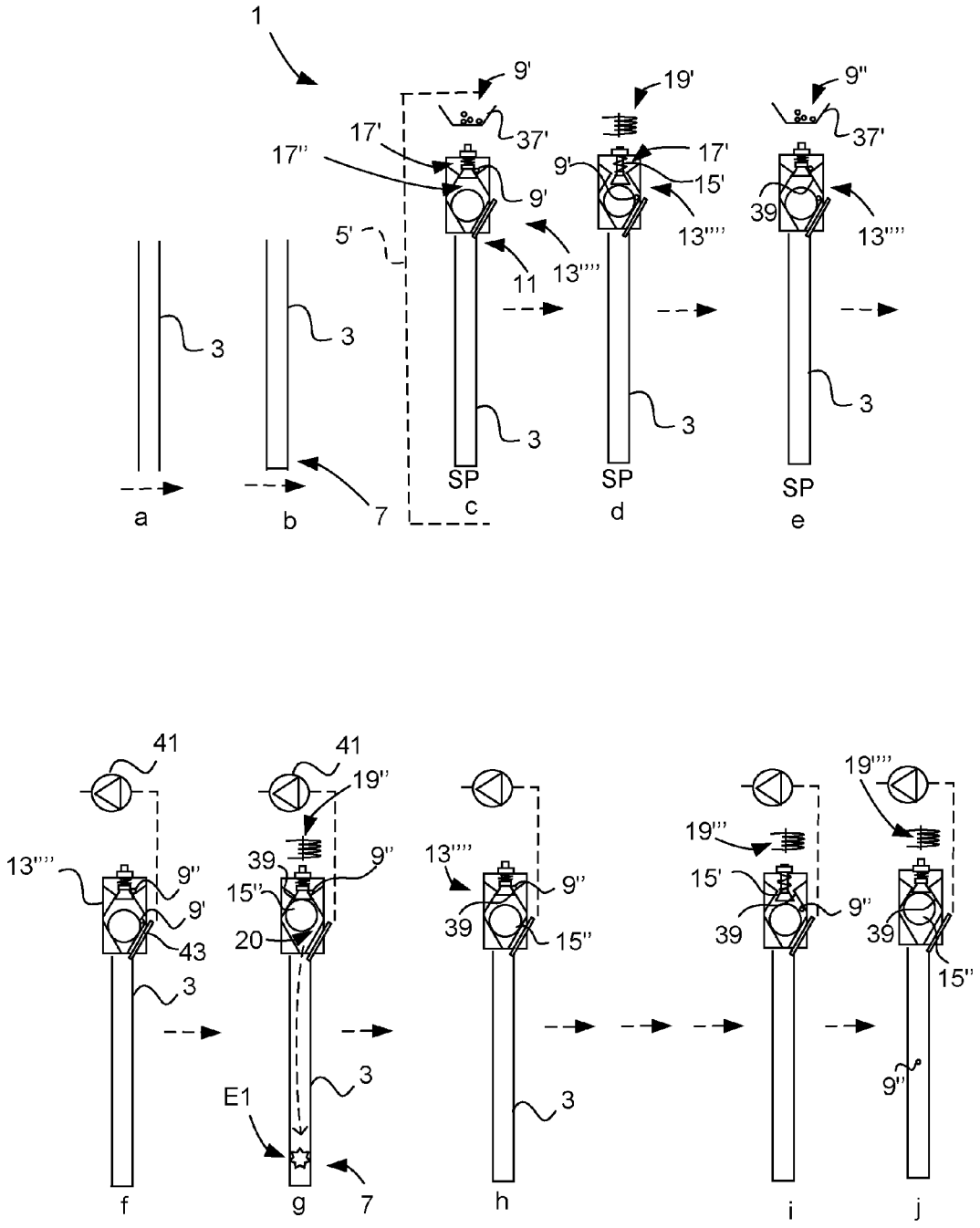
Figures 7A, 7B, 7C:
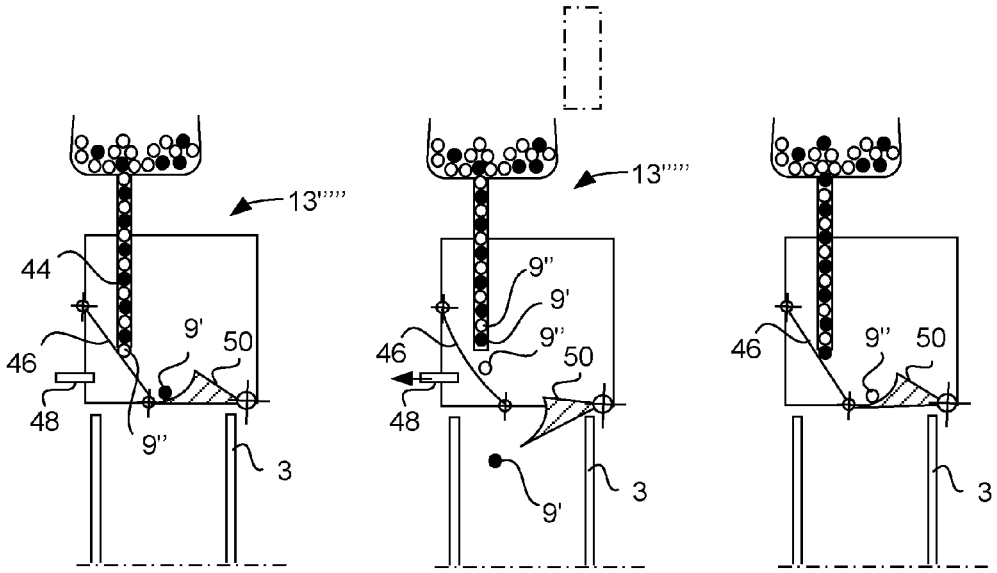
Figure 8:
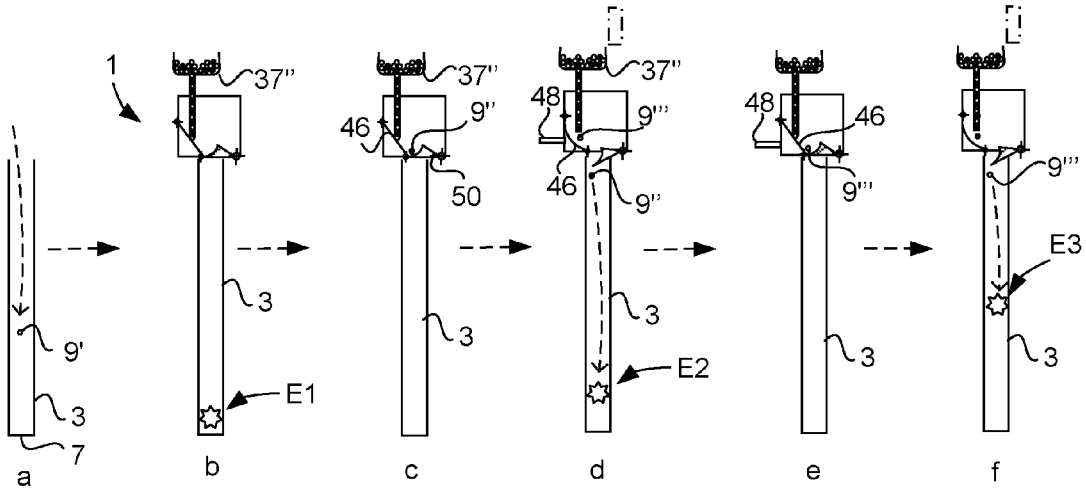

The invention will now be explained with reference to the drawing, which schematically shows:

FIG. 1 a vertical pumping device according to a first embodiment of the invention;

FIG. 2 a means arranged for allowing the release of mercury in an exact predetermined first and second amount, respectively, in a second embodiment;

FIG. 3 a top view of a vertical pumping device according to a third embodiment;

FIG. 4 a top view of a vertical pumping device according to a fourth embodiment;

FIG. 5 a vertical pumping device according to a preferred embodiment with shown indexed process positions a-j;

FIG. 6*a*-6*g* the mode of operation of a distribution valve of the vertical pumping device in FIG. 5;

FIG. 7*a*-7*c* a means arranged for allowing the release of mercury in exact predetermined first and second amounts, respectively, in a sixth embodiment; and FIG. 8 the mode of operation of the means in FIG. 7*a*-7*c* in a vertical pumping device.

DETAILED DESCRIPTION OF EMBODIMENTS AND PREFERRED EMBODIMENTS

The invention will now be explained by means of embodiments. Details in the schematic drawings may occur representing the same type of detail, but in different figures with the same reference numeral. The drawings are not to be interpreted strictly, and details that are not important to the invention have been left out therefrom for the sake of clarity.

FIG. 1 shows schematically a vertical pumping device 1 according to a first embodiment. FIG. 1 shows a method of internally distributing an exact amount of mercury (Hg) in a fluorescent tube body 3 at the vertical pumping device 1. Fluorescent tube bodies 3 with open ends are conveyed by a conveyor (not shown) to a pumping station 5. The conveyor and the pumping station 5 are comprised in the vertical pumping device 1. A bottom 7 is applied to one end of the fluorescent tube body 3 by closing the other downward facing end of the fluorescent tube body 3 (reference a). Then, in a first position (reference b), there is arranged at least one first solid body 9' comprising a predetermined first amount of bound mercury. The solid body 9' with bound Hg is in the form of a ball and also comprises tin Sn, in amalgam association with the mercury. Each fluorescent tube body 3 is applied manually with the first solid body 9' by dropping down the respective ball into the open upper end 11 of each fluorescent tube body so that the ball lands in the bottom 7 of the fluorescent tube body. Then, the fluorescent tube bodies 3 are conveyed separately and stepwise further on to the vertical pumping station 5, where the upper end 11 of the fluorescent tube body is applied with a distribution valve 13', tightly fitting and comprising a valve element 15 in the form of a spherical body. A set of balls of second solid bodies 9" of bound Hg with zinc Zn has been loaded above the distribution valve 13'. In the first position, the first solid body 9' is thus dropped down manually to the bottom 7 before the distribution valve 13' is applied connecting to the fluorescent tube body 3. Thus, in a second position, there is arranged a second solid body 9" comprising a predetermined second amount of bound Hg. The second solid body 9" is placed in position in the distribution valve 13' and lies ready in the chamber 17 of the distribution valve 13' to be fed out to the fluorescent tube body 3 (reference c). The upper end 11 of the fluorescent tube body 3 is, via the tightly connected distribution valve 13', coupled to an evacuation pump 14 for creating an underpressure in the fluorescent tube body 3. The fluorescent tube body 3 is then gassed after underpressure having been applied in the fluorescent tube body 3. When, through underpressure and heat in the fluorescent tube body 3, the gassing has come to a point where the particle flow with contaminants has stopped, the first amount of Hg is released in the fluorescent tube body 3 by gasification (reference d). This is effected through the supply of heat generated in the pumping process. A gas expansion occurs in the lower part of the fluorescent tube body 3 when the bound mercury is gasified in release E1 and the particle flow with contaminants starts to move in the upward direction in the fluorescent tube body 3 and out through an exit opening (not shown) arranged in the distribution valve 13' for the removal of contaminant particles and purification. The fluorescent tube body 3 is then conveyed on to further indexed process positions (not shown), and in a process position further on (reference e) an electromagnet 19 provides a lifting of the valve element 15 thereby opening a gap between the fluorescent tube body 3 and the chamber 17 so that the second solid body can fall down into the fluorescent tube body 3 and thereby achieve a second release E2 of the second amount of Hg in the fluorescent tube body 3 by gasification. This amount of Hg in gaseous form forms the lamp gas of the fluorescent tube body 3. The second solid body 9" with bound Hg also comprises zinc Zn bound with the mercury, which is released from the mercury and thus brings about the gasification at a higher temperature than for tin Sn. In this way the production of fluorescent tubes can be made more efficient, and the temperature rise occurring in the different process steps of the vertical pumping device 1 is utilized naturally. After the second release E2 has been achieved, the upper end 11 of the fluorescent tube body 3 is closed tightly, and the respective fluorescent tube body 3 is released from the vertical pumping device 1 (reference f).

FIG. 2 shows schematically a means in the form of a distribution valve 13" arranged for the feeding out solid balls 9', 9" with bound Hg, one by one in suitable indexed process positions allowing the release of mercury in gaseous form. The distribution valve 13" comprises a cylinder 21 being rotatable about a vertical axis X and extending in vertical direction. The cylinder 21 is divided into two chambers 17', 17" by a partition wall 23, each chamber 17', 17" being adapted for taking up first and second solid bodies 9', 9" with bound mercury Hg. The first and second valve elements of the distribution valve 13" are thus formed by the partition wall 23 arranged in the cylinder 21. The various solid bodies 9', 9" are built with predetermined amounts of bound mercury in solid form. The first solid bodies 9' comprise a smaller amount of mercury than the second solid bodies 9". By making the first and the second amount of mercury Hg distributable to the fluorescent tube body 3 in a very exact way as to content of mercury, it has turned out that great environmental objectives are attained and a cost-effective production of fluorescent tubes is achieved. First and second solid bodies with bound solid mercury Hg can thus be arranged in an indexing position. Distribution valves 13" are arranged in and above each support position to retain the respective fluorescent tube body 3 tightly against the vertical pumping device 1 via an adapter 26. The chambers 17', 17" of each distribution valve 13" are provided with Hg balls, each chamber 17', 17" with one type of Hg ball. When then the support positions with the fluorescent tube bodies 3 are then moved to the different indexed process positions, in positions for achieving the release of a separate Hg ball (individually separated from the others in the chamber by a separating mechanism, not shown) from the distribution valve 13", an actuator 25 will, in a process position for release, influence a corresponding cam member 27 projecting from the outside of the cylinder 21 to rotate the cylinder 21 a quarter turn about the vertical axis X, which is time saving. When the first body 9' is to be brought into the fluorescent tube body 3 for the first release of mercury, the hollow cylinder 21 is rotated a quarter turn about its axis of rotation X by a camming motion and then, to close, a quarter turn back. When the second body 9" is to be brought into the fluorescent tube body 3 for the second release of mercury, the hollow spindle is rotated a quarter turn in the direction towards the previously made quarter turn by means of a second camming motion. In this manner the second solid body is fed down into the fluorescent tube body 3.

FIG. 3 shows a vertical pumping device 1 schematically from above according to a third embodiment. The vertical pumping device 1 is constructed as a tower being rotatable about a vertical axis of rotation z comprising a predetermined number of indexed process positions P and a carousel 29 with upper and lower support blocks 31 for supporting the fluorescent tube bodies 3. The arrow P1 shows the feeding position for feeding in the fluorescent tube body 3 in the carousel 29. In position a, a distribution valve 13'" in an upper chamber is loaded with a first solid body 9' with bound mercury Hg. In position b, a permanent magnet 33 influences the distribution valve 13'" such that the first solid body 9' falls down into a lower chamber of the distribution valve 13". Then a second solid body 9" with bound mercury Hg is fed into the upper chamber, the distribution valve 13' being loaded with the two bodies 9', 9". Pumping/gassing then occurs during the conveyance of the fluorescent tube body 3 along the circle arc denoted by B. In position d, the lower chamber is opened to the interior of the fluorescent tube body 3, and the first body 9' falls down into the fluorescent tube body 3 to be vapourized in a first release E1, and an expansion of gas occurs in the lower part of the fluorescent tube body 3, expelling contaminants. In position e, a permanent magnet 33 opens a valve (not shown) between the upper and the lower chamber (not shown) and allows the second body 9" to fall down from the upper chamber to the lower chamber. In position f, an additional permanent magnet 33 disposed at the end of the completed revolution of the carousel 29, once again influences the distribution valve 13'" such that the lower chamber is opened to the interior of the fluorescent tube body 3 and the second body 9" falls down into the fluorescent tube body 3 to be vapourized in a second release E2, and lamp gas is made from Hg.

FIG. 4 shows schematically a top view of a vertical pumping device 1 according to a fourth embodiment, where three different types of solid bodies 9', 9", 9" with bound Hg can be distributed in the vertical pumping device 1. The fluorescent tube body 3 is provided with a bottom 7 in position a. A first body 9' of bound Hg (in the form of pellets) is dropped down to the bottom 7 and is thus arranged (position b) in a first position so that it can be released later on the given command. A second body 9" of bound Hg (in the form of pellets) is fed to a distribution valve (not shown) in position c. A third body 9" of bound Hg (in the form of pellets) is fed to the distribution valve in position d. In position e, mercury is released E1 in gaseous form from the first body 9' with bound mercury. In position f, mercury is released E2 in gaseous form for complementary pumping of contaminant particles from the fluorescent tube body 3 from the second body 9" Hg. In position g, mercury is released E3 from the third body 9" to form lamp gas. By way of the solid form of the three bodies 9', 9", 9", the exact amount of Hg can be determined for the production of fluorescent tubes, both for pumping and for final supply of an exact amount of mercury for the lamp gas. Before the fluorescent tube leaves the carousel 29, the other end 11 of the fluorescent tube body 3 facing upwards is closed in position h. Then, the fluorescent tube body 3 with closed ends is released from the vertical pumping device 1.

FIG. 5 (see also FIG. 6*a*-6*g*) shows schematically a vertical pumping device 1 according to a preferred embodiment with shown indexed process positions a-j for the embodiment. In position a, fluorescent tube bodies 3 are being conveyed to the vertical pumping device 1. In position b, the bottom 7 is closed. In position c, the fluorescent tube body 3 is fed into a pumping tower 5', and the upper end 11 of the fluorescent tube body 3 is coupled tightly to a distribution valve 13"". At each support position SP for a respective fluorescent tube body 3 there is disposed a distribution valve 13'". In position c, the fluorescent tube body 3 is positioned under a first filling box 37' in a first indexed process position for filling. A first solid body 9' of bound Hg is brought from the first filling box 37' to the upper chamber 17' of the distribution valve 13"". In position d, an electromagnet 19' presses a spring-loaded first valve 15' in the direction towards the spring-load and opens a gap between the upper chamber 17' and a lower chamber 17" of the distribution valve 13"", where the first solid body 9' falls down into the lower chamber 17" from the upper chamber 17'. In position e, the valve 15' has been fitted tightly, by means of the spring-load, against a shoulder 39 arranged between the upper 17' and the lower 17'" chambers, and the fluorescent tube body 3 has arrived in an indexed process position where a second filling box with second solid bodies 9" of Hg, differing in properties different from the first 9' solid bodies, where a second body 9" of Hg is fed down into the upper chamber 17'. The distribution valve 13"" is now loaded with an exact amount of Hg for distribution to the fluorescent tube body 3 for pumping as well as final filling of lamp gas. In position f, the fluorescent tube body 3 is provided with underpressure by means of a vacuum pump 41 via a conduit and socket 43 through the distribution valve 13"", and gassing of the fluorescent tube body 3 occurs. In position g, a complementary pumping is achieved by generating the first release E1 of mercury, by gasification of the bound mercury of the first body 9', in the fluorescent tube body 3, expelling contaminants. This is achieved in that the distribution valve 13"" in position g ends up under a second permanent magnet 19", which lifts a valve ball 15" so that a gap 20 is formed between the lower chamber 17" and the interior of the fluorescent tube body 3, where the first body 9' can fall down by gravity to the bottom 7 of the fluorescent tube body 3.

In position h, the fluorescent tube body 3 is conveyed to the next indexed process position for filling of lamp gas, where the valve ball 15" is in its closed position. In position i, the spring-loaded valve 15' is once again influenced by a third electromagnet 19'" arranged in this indexed process position and pressed down to allow arranging of the second solid body 9" in the lower chamber 17" so that, in the next position j, an additional fourth electromagnet 19"" lifts the valve ball 15" to allow the second solid body 9" to fall down into the fluorescent tube body 3 by gravity for production of the exact amount of lamp gas with the exact amount of mercury through a second release E2 of mercury.

Figure 6A:
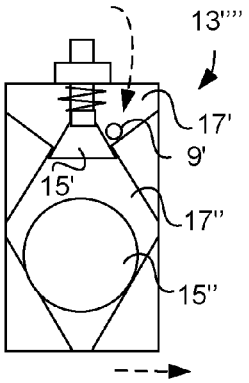
Figure 6B:
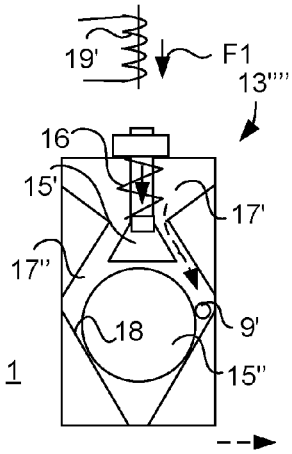
Figure 6C:
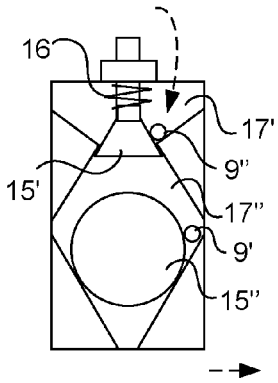
Figure 6D:
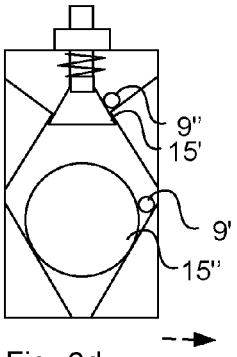
Figure 6E:
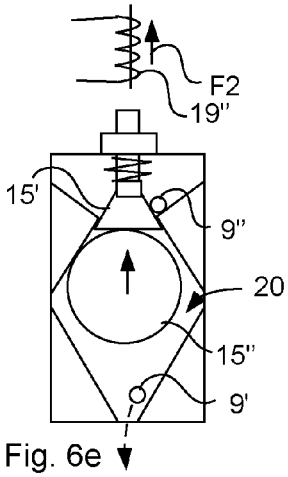
Figure 6F:
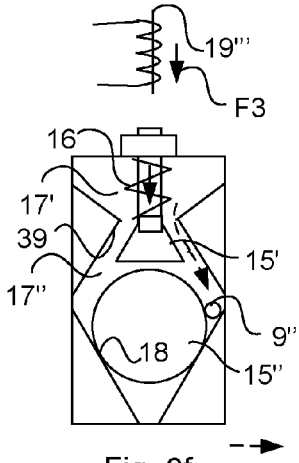
Figure 6G:
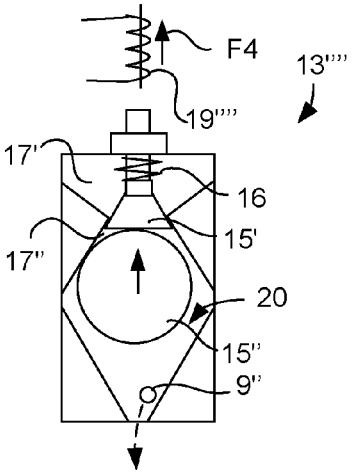

FIGS. 6*a*-6*h* show schematically the mode of operation of the distribution valve 13"" of the vertical pumping device 1 in FIG. 5. FIG. 6*a* shows how the first solid body 9' is initially placed in the upper chamber 17'. In FIG. 6*b*, the first electromagnet 19' forces the valve 15' arranged in a specific indexed process position (position d in FIG. 5) to open with a downward directed force F1 overcoming the force from a tension spring 16. The valve ball 15" is also influenced by the magnetic downward directed force F1, but is hindered by the shoulder 18 forming the lower chamber 17". At the above-mentioned opening, the first solid body 9' falls down to be arranged down in the lower chamber 17". In FIG. 6*c* it is shown how the second solid body 9" is fed into the upper chamber 17'. The distribution valve 13"" is now loaded with the first and the second solid body 9', 9", respectively, with bound mercury according to FIG. 6*d* and is ready to deliver an exact amount of mercury for pumping and filling of lamp gas. In FIG. 6*e* it is shown how a second electromagnet 19" with an, in comparison with the direction of force of the first electromagnet 19', upward directed force F2 lifts the valve ball 15" and opens the gap 20, and the first solid body 9' is dropped down into the fluorescent tube body (not shown) in a vertical pumping tower (not shown). In the next FIG. 6*f*, an earlier mentioned stepwise rotating carousel (not shown) is rotated momentarily with stops in the various indexed process positions and arrives in yet another process position so that the fluorescent tube body and the distribution valve 13"" end up under a third electromagnet 19'", which with a downward directed force F3 once again forces down the valve 15' so that the second solid body 9" is fed into the lower chamber 17". In FIG. 6*g*, the second solid body 9" is fed into the fluorescent tube body in that a fourth electromagnet 19"" lifts the valve ball 15" with a force F4. When the second and the fourth 19", 19"" electromagnet in the respective process position lifts the valve ball 15" with the force F2 and F4, respectively, the valve 15' will also be influenced by the force, but is kept closed by the shoulder 39.

FIGS. 7*a*-7*c* show schematically a means in the form of a membrane valve 13""' arranged to allow the release of mercury in exact, predetermined first and second amounts according to a further embodiment. In FIGS. 7*a*-7*c*, the first 9' and the second 9' bodies are shown spherical and with filled out and not filled out illustrations, but symbolise that the first and the second bodies 9', 9" have the same amount of Hg with bound Zn for the two types of solid bodies, that is, are identical. The bodies 9', 9" may thus be filled into a common closed filling space. An airtight pipe 44 leads down into the membrane valve 13"'". A membrane 46, controlled by underpressure via suction pipe 48, ensures feeding of solid bodies 9', 9" one by one onto a valve flap 50. In the position shown in FIG. 7*b*, the valve flap 50 opens and lets the first body 9' down into the fluorescent tube body 3. At the same time the membrane 46 is momentarily affected by a force through underpressure, created by underpressure in the suction pipe 48, and springs down so much as to allow the next solid body 9" space to fall down to the position against the valve flap 50, shown in FIG. 7*c*.

FIG. 8 shows schematically the mode of operation of the membrane valve 13"'" in FIG. 7*a*-7*c* in a vertical pumping device 1. The mode of operation comprises the method of internally distributing Hg in a fluorescent tube body 3 in the vertical pumping device 1 according to a sixth embodiment. The method comprises the steps of providing a bottom 7 by closing the downward facing end of the fluorescent tube body 3 by heating. In FIG. 8, in position a, it is shown how to arrange, in a first position, the first solid body 9' comprising the predetermined first amount of bound Hg to be able to achieve a first release E1 of the first amount of Hg in the fluorescent tube body 3 by gasification, which is shown in position b where also the filling space 37" has been filled with solid first and second bodies 9', 9". In position c, the membrane 46 has been influenced, and a second body 9" has been brought into position at the valve flap 50. This is to say that the device has arranged, in a second position, at least the second solid body 9" comprising a predetermined second amount of bound Hg so as to be able to achieve a second release of the second amount of Hg in the fluorescent tube body 3 by gasification. In position d it is shown how to achieve the second release E2 of the second amount of Hg with heat and underpressure attained in the fluorescent tube body 3 for complementary purification. In position e, the valve flap 50 springs up and catches an additional third solid body 9'", thus arranging it. Finally, in position f, the device brings about a further release E3 of a predetermined amount of Hg in gaseous form from bound mercury in the third solid body 9'" with heat and underpressure. Thereby mercury vapour is formed in the fluorescent tube body 3, which is used for the lamp gas for the operation of the finished fluorescent tube. The fluorescent tube body 3 is then released from the vertical pumping device 1 (the same principle as step f in FIG. 1).

The invention should not be considered to be limited by the embodiments described above, and there are also other embodiments within the scope of the invention which likewise describe the gist of the invention or combinations of the described embodiments. Other substances can of course be bound with mercury, such as tin, zinc, copper, silver, gold, titanium etc. Also other types of distribution valves can be used for the above-mentioned release. Other positions for arranging further solid bodies with bound Hg could also be of interest, depending on the desired degree of pumping in the process. For example, mercury may be arranged in the vertical pumping device in four process positions for further pumping and final filling of the fluorescent tube body to obtain improved service-life of the fluorescent tube simultaneously with sparing the environment through the exact, predetermined desired amount of Hg released according to the invention in all of the four process positions. The important thing is that the inventors of the present invention solve the problem of Hg environmental impact and the problem of high production costs by applying Hg in an exact amount in the fluorescent tube body, both at the pumping and when generating lamp gas. Different types of spring valves with pressure springs, tension springs, other elastic elements and valve bodies can be used for achieving a suitable valve unit for distribution of an exact amount of mercury.

The invention claimed is:

1. A method of internally distributing Hg in a fluorescent tube body in a vertical pumping device, comprising:

providing a bottom by closing the downward facing end of the fluorescent tube body;

arranging, in a first position, at least one first solid body comprising a predetermined first amount of bound Hg to be able to achieve a first release of the first amount of Hg in the fluorescent tube body by gasification;

arranging, in a second position, at least one second solid body comprising a predetermined second amount of bound Hg to be able to achieve a second release of the second amount of Hg in the fluorescent tube body by gasification;

achieving the said first release of the first amount of Hg with heat and under pressure attained in the fluorescent tube body for purification;

achieving the said second release of the second amount of Hg with heat and under pressure attained for the occluded mercury vapour of the fluorescent tube body; and releasing the fluorescent tube body from the vertical pumping device, wherein, in the first position, the first solid body is dropped down manually to the bottom before a valve unit is applied connecting to the fluorescent tube body, the valve unit being arranged in such a manner as to be openable so that, in the second position, the second solid body can drop down into the fluorescent tube body by gravity.

2. The method according to claim 1, further comprising:

coupling the upper end of the fluorescent tube body to an evacuation pump to achieve an under pressure in the fluorescent tube body, the coupling taking place before the step of arranging, in the first position, the first solid body.

3. A method of internally distributing Hg in a fluorescent tube body in a vertical pumping device, comprising:

providing a bottom by closing the downward facing end of the fluorescent tube body;

arranging, in a first position, at least one first solid body comprising a predetermined first amount of bound Hg to be able to achieve a first release of the first amount of Hg in the fluorescent tube body by gasification;

arranging, in a second position, at least one second solid body comprising a predetermined second amount of bound Hg to be able to achieve a second release of the second amount of Hg in the fluorescent tube body by gasification;

achieving the said first release of the first amount of Hg with heat and under pressure attained in the fluorescent tube body for purification;

achieving the said second release of the second amount of Hg with heat and under pressure attained for the occluded mercury vapour of the fluorescent tube body; and releasing the fluorescent tube body from the vertical pumping device, wherein a valve unit is arranged in such a manner as to be openable so that, in the first position, the first solid body can drop down to the bottom by gravity and, in the second position, the second solid body can drop down into the fluorescent tube body by gravity.

4. A method of internally distributing Hg in a fluorescent tube body in a vertical pumping device, comprising:

providing a bottom by closing the downward facing end of the fluorescent tube body;

arranging, in a first position, at least one first solid body comprising a predetermined first amount of bound Hg to be able to achieve a first release of the first amount of Hg in the fluorescent tube body by gasification;

arranging, in a second position, at least one second solid body comprising a predetermined second amount of bound Hg to be able to achieve a second release of the second amount of Hg in the fluorescent tube body by gasification;

achieving the said first release of the first amount of Hg with heat and under pressure attained in the fluorescent tube body for purification;

achieving the said second release of the second amount of Hg with heat and under pressure attained for the occluded mercury vapour of the fluorescent tube body; and releasing the fluorescent tube body from the vertical pumping device, wherein a distribution valve is arranged with a first valve element delimiting an upper and a lower chamber of the distribution valve, and a second valve element delimiting the lower chamber and the fluorescent tube body, the method comprising placing, after the distribution valve has been applied connecting to the fluorescent tube body, the first and the second solid body in the lower and the upper chamber, respectively.

5. The method according to claim 1, wherein the step of releasing the fluorescent tube body from the vertical pumping device is preceded by a step of closing the other upward facing end of the fluorescent tube body.

6. The method according to claim 1, wherein the method comprises obtaining the solid bodies with bound Hg by cutting of a bar blank of bound mercury in solid form to predetermined lengths and subsequent conveyance to the vertical pumping device.

7. A vertical pumping device for pumping of fluorescent tube bodies, the vertical pumping device comprising:

a tower being rotatable about a vertical axis comprising several peripherally arranged support positions exhibiting upper and lower support blocks for supporting the fluorescent tube bodies, the vertical pumping device being arranged to dispose the support positions in indexed process positions at stepwise rotation of the tower, wherein the vertical pumping device comprises a first indexed process position, provided with a first amount of Hg in the fluorescent tube body, which is releasable from at least one first solid body comprising a predetermined first amount of bound Hg and, wherein a distribution valve arranged at each support position is designed to take up the first and the second solid body and, in separate process positions, feed them further on to the respective fluorescent tube body, each distribution valve comprising a first and a second valve element, each of which is separately influenceable by magnet units fixedly arranged in predetermined process positions in the vertical pumping device to arrange the first and the second body in a first and a second position, respectively; and a second indexed process position provided with a second amount of Hg in the fluorescent tube body, which is releasable from at least one second solid body comprising a predetermined second amount of bound Hg.

8. The vertical pumping device according to claim 7, wherein a distribution valve arranged at each support position is designed with a first valve element delimiting an upper and a lower chamber and a second valve element, in operation delimiting the lower chamber from the fluorescent tube body, the first valve element being arranged so as to be influenceable by magnet units while the second valve element remains in the closed position, and where the second valve element is anranged so as to be influenecable by magnet units while the first valve element remains in closed position.

9. The vertical pumping device according to claim 7, wherein the said magnet unit is constituted by a first electromagnet generating a first force and by a second electromagnet generating a second force, said electromagnets being placed in predetermined separate process positions.

10. The vertical pumping device according to claim 9, wherein the first and the second electromagnets generate forces in opposite directions.

11. The vertical pumping device according to claim 7, wherein the first and the second valve elements of the distribution valve are formed by a partition wall arranged in a hollow cylindrical cylinder being rotatable about its axis of rotation around which, and on substantially opposite sides, there are arranged storage spaces for first and second solid bodies, respectively.

12. The vertical pumping device according to claim 7, wherein the first indexed process position allowing release of the first amount of Hg in the fluorescent tube body is arranged with heat.

13. The vertical pumping device according to claim 7, wherein units are provided to arrange, in a third position, at least one third solid body comprising a predetermined third amount of bound Hg to be able to achieve a third release of the third amount of Hg in the fluorescent tube body by gasification.

14. The method of claim 1, wherein the valve unit is arranged in such a manner so as to be openable by magnetic force.

15. The method of claim 3, wherein the valve unit is arranged in such a manner so as to be openable by magnetic force.

16. The method of claim 4, wherein the valve unit is arranged in such a manner so as to be openable by magnetic force.

* * * * *